United States Patent [19]

Kohake et al.

[11] Patent Number: 4,824,054

[45] Date of Patent: Apr. 25, 1989

[54] RAILROAD SWITCH STAND

[76] Inventors: Edward Kohake, 413 Rice Rd., Silver Lake, Kans. 66539; John T. Butler, 3000 SW. Gisbourne, Topeka, Kans. 66614

[21] Appl. No.: 214,894

[22] Filed: Jun. 28, 1988

Related U.S. Application Data

[63] Continuation of Ser. No. 1,743, Jan. 9, 1987, abandoned.

[51] Int. Cl.[4] ..... B61L 5/02

[52] U.S. Cl. ..... 246/406; 246/489

[58] Field of Search ..... 246/393, 399, 401, 402, 246/404, 406, 407, 409, 489; 464/32

[56] References Cited

U.S. PATENT DOCUMENTS

| | | | |
|---|---|---|---|
| 292,095 | 1/1884 | Carlson | 464/32 |
| 340,719 | 4/1886 | Jervis | 246/407 |
| 401,671 | 4/1889 | Alkins | 246/406 |
| 406,500 | 7/1889 | Boyd | 246/406 |
| 569,730 | 10/1896 | Wagner | 246/406 |
| 746,911 | 12/1903 | Anderson | 464/32 |
| 908,578 | 1/1909 | King | 246/406 |
| 913,163 | 2/1909 | Reinoehl et al. | 246/404 |
| 939,279 | 11/1909 | Legault | 246/406 |
| 1,088,119 | 2/1914 | Anderson | 246/406 |
| 1,325,396 | 12/1919 | Cuellar | 246/406 |
| 1,336,195 | 4/1920 | Carr | 246/406 |
| 2,610,291 | 9/1952 | McGarry | 246/401 |
| 3,652,849 | 3/1972 | Kleppick | 246/393 |

*Primary Examiner*—Joseph F. Peters, Jr.
*Assistant Examiner*—Clifford T. Bartz
*Attorney, Agent, or Firm*—Hovey, Williams, Timmons & Collins

[57] ABSTRACT

A railroad switch stand is provided by which a switchman can easily and conveniently throw a railroad switch while standing, which automatically locks in respective open and thrown positions, and which automatically disconnects from the switch throw rod in the event excessive longitudinal force is applied to the throw rod, the preferred switch stand includes a hand-operable, rotatable throw wheel; means mounting the wheel at about normal chest height; structure for translating rotation of the wheel into longitudinal movement of the rod; and means for releasably locking the wheel in respective, alternate open and thrown positions. In use, a switchman releases the locking means and rotates the throw wheel through one revolution in order to throw the switch to its alternate position at which point the locking means automatically engages the throw wheel to prevent further rotation thereof.

7 Claims, 3 Drawing Sheets

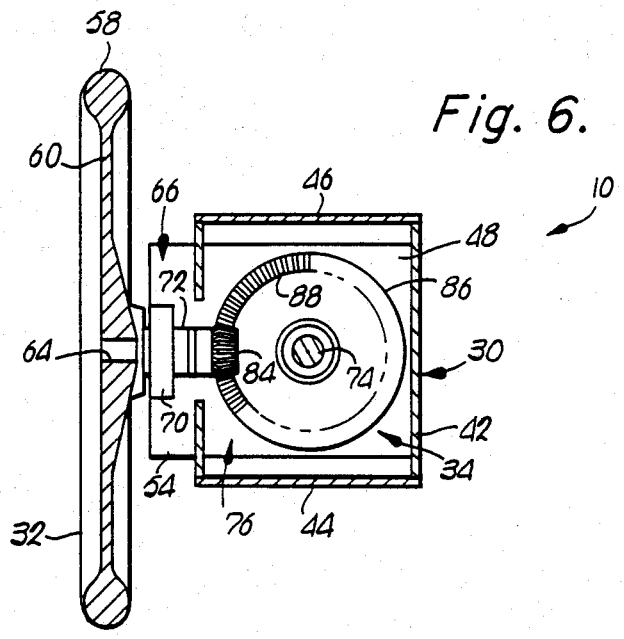
Fig. 6.
Fig. 5.
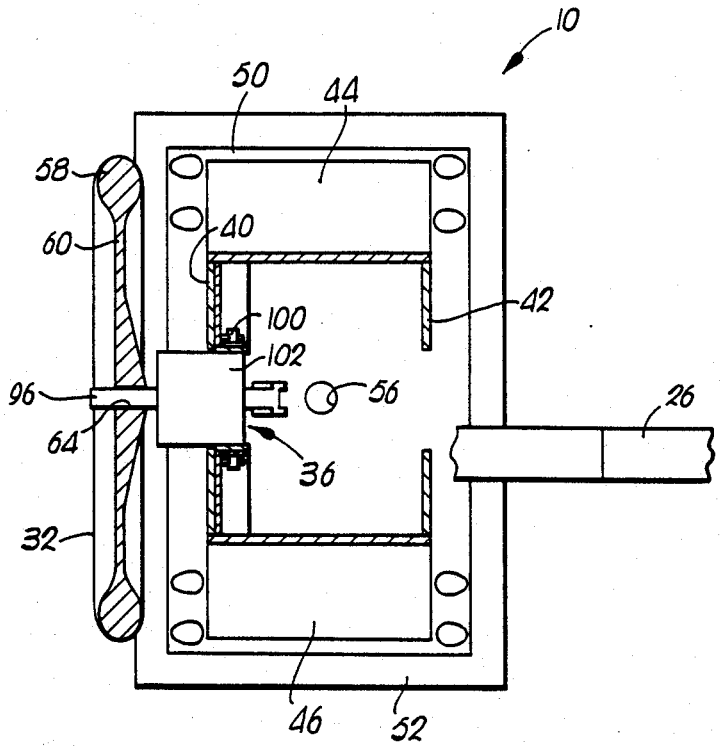

RAILROAD SWITCH STAND

This application is a continuation of application Ser. No. 07/001,743, filed Jan. 9, 1987, now abandoned.

BACKGROUND OF THE INVENTION

1. Field of the Invention

This invention relates to a railroad switch stand of simple yet highly effective construction which has numerous advantages including ease of operation by a switchman without bending over, automatic locking, and automatic disconnecting in the event a train runs through the switch that is lined against it, for example. More particularly, it is concerned with a switch stand having a hand operable, rotatable throw wheel mounted at about normal chest height, means coupling the throw wheel with the throw rod for translating rotation of the throw wheel into longitudinal movement of the rod, a locking bar for engaging a slot in the wheel, and a shear pin breakable for disconnecting the throw rod if excessive axial force is applied thereto.

2. Description of the Prior Art

U.S. Pat. No. 401,671 issued to Alkins in 1889, illustrates one type of railway switch stand still in common usage today. This type of switch stand is operated by lifting and rotating a weighted rod from one position to another. This type of switch stand has the substantial disadvantage of subjecting the switchman to potential back and leg injury.

Another type of switch stand in common usage is known as the HIGHSTAR manufactured by Pettibone-Mulliken. This switch stand includes a vertical throw shaft with a link affixed to the lower end and extending outwardly on opposed sides thereof. Each end of the link includes an upwardly extending boss selectively and pivotally received in a pivot hole defined in the outboard end of the switch throw rod. A pair of retaining brackets retain the throw rod engaged with the selected boss. The throw shaft also includes a vertically pivotal, lockable, outwardly extendable handle used as a lever to rotate the throw shaft. The upper end of the throw shaft includes a banner or target for indicating the position of the switch.

Attempts to improve on the commonly used switch stand designs have not come into widespread usage perhaps because of mechanical complexity and the associated installation and maintenance cost. For example, U.S. Pat. No. 3,652,849 illustrates a foot-operated, switch-connected lever movable to operate a switch between open and thrown positions. This type of switch stand, however, presents greater mechanical complexity than desired and may become inoperable if snow or gravel become piled under the foot pedals of the device.

Some prior art devices, such as that illustrated in U.S. Pat. No. 1,325,396, employ a rotatable wheel mounted at track level. This requires a switchman to bend over to operate the wheel subjecting the switchman to potential back injury. Additionally, this type of switch does not provide a mechanism for automatically locking the switch stand in the open or thrown to indicate that the switch is not positioned therebetween.

Finally, prior art switch stands are susceptible to damage when a train runs through a switch that is lined against it. When this happens, the movable rails of the switch force the throw rod to move axially which can severely damage the mechanism of the switch stand and the switch itself. Conversely, if the rails of the switch become immovable due to snow, ice, gravel, or the like, forcible operation of the switch stand also causes excessive axial force on the throw rod which can similarly damage the mechanism of the switch stand. None of the known prior art devices provides a means for automatically disconnecting the mechanism in the switch stand from the throw rod whenever excessive axial force is applied thereto in order to prevent damage to the switch stand mechanism and the throw rod.

SUMMARY OF THE INVENTION

The problems outlined above are solved by the railroad switch stand in accordance with the present invention. That is to say, the switch stand hereof allows a switchman to throw and open the switch while standing, is mechanically simple, automatically locks the switch stand in respective open and thrown positions, and automatically disconnects the switch stand mechanism from the throw rod in the event excessive axial force is applied thereto.

The railroad switch stand in accordance with the present invention broadly includes a hand operable, rotatable member; means mounting the wheel at about normal chest height; and switch coupling means for operably coupling the member with the throw rod for translating rotation of the member into axial movement of the throw rod, including structure for multiplying the force applied to the member during rotation thereof, and for applying the multiplied force to the throw rod in order to axially move the throw rod between respective open and thrown positions thereof upon selective rotation of the member.

In particularly preferred forms, the switch coupling means includes an upright, axially rotatable throw shaft, a pinion gear coaxially mounted to the member and a rack gear engaging the pinion gear coaxially mounted to the shaft, and a link coupled with an extending outwardly on opposed sides of the shaft including a pair of bosses located respectively adjacent opposed ends of the link for selective, alternate pivotal reception in a connecting hole defined in the end of the throw rod. Additionally, the rotatable member is preferably a wheel, one full revolution of which corresponds to the rotation of the wheel between the first and second positions.

Furthermore, the preferred switch stand includes locking means for releasably and automatically locking the rotatable member in the first and second positions respectively.

Finally, the preferred switch stand includes a disconnecting means for disconnecting the member from the throw rod in the event excessive axial force is applied thereto.

BRIEF DESCRIPTION OF THE DRAWINGS

FIG. 5 is a plan view of the switch stand in partial section along line 5—5 of FIG. 3;

FIG. 6 is upwardly looking view of the switch stand in partial section along line 6—6 of FIG. 3.

DESCRIPTION OF THE PREFERRED EMBODIMENT

Figure 1:
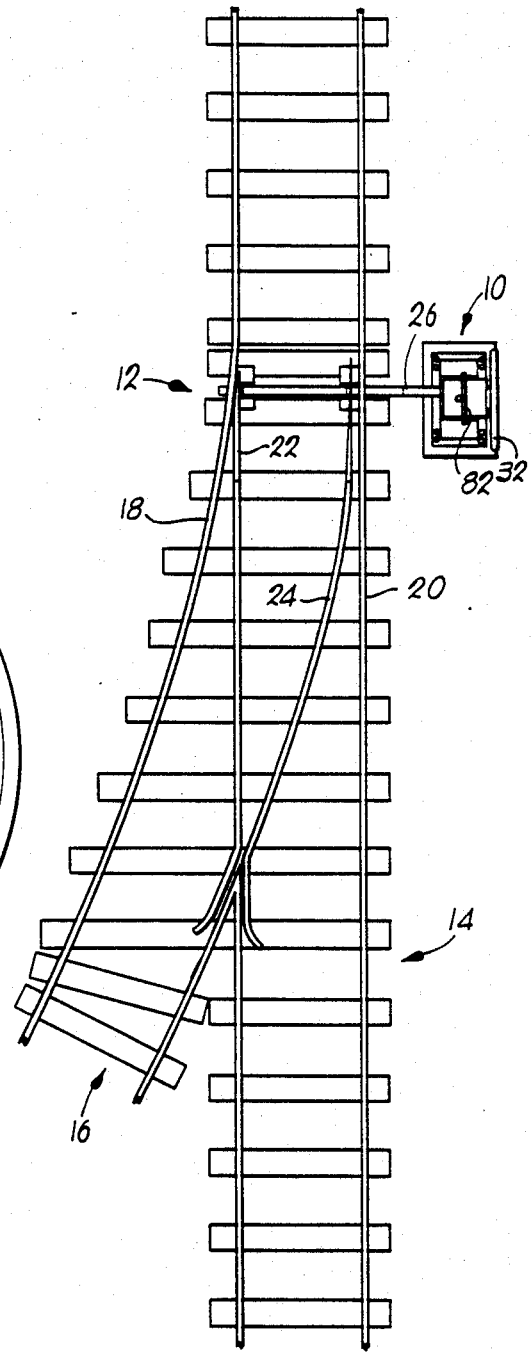
FIG. 1 is a plan view of the switch stand showing it in use with a railroad switch.

Switch stand 10 is preferably used in the environment of a conventional railroad switch 12 which when in the thrown position, allows a train traveling along a straight track 14 (from top to bottom as viewed in FIG. 1) to be diverted to siding 16. Switch 12 includes curved fixed rail 18, straight fixed rail 20, straight movable rail 22, curved movable rail 24, and elongated, outwardly extending throw rod 26 to which movable rails 22, 24 are coupled. Throw rod 26 present an S-shaped configuration (FIG. 3) and includes pivot hole 28 defined in the outboard end thereof.

In FIG. 1, switch 12 and throw rod 26 are shown in the "open" position in which a train traveling along track 14 is not diverted onto curved track 16. To place switch 12 and throw rod 26 in the "thrown" position, as shown in FIGS. 2–6, switch stand moves rod 26 to the right, as viewed in FIG. 1, so that rail 24 abuts the inboard side of rail 20 and so that rail 22 moves away from rail 18.

Switch stand 10 in accordance with the present invention broadly includes frame 30, hand operable, rotatable throw wheel 32, switch coupling means 34, locking means 36, and disconnecting means 38.

Frame 30 includes trapezoidal from wall 40, trapezoidal rear wall 42, rectangular side walls 44 and 46, front-overhanging top wall 48, and base plate 50.

Walls 40–48 and base plate 50 are preferably composed of steel plate and welded together to form a solid, integral frame.

Top wall 48 presents a portion 54 extending outwardly over front wall 40 the purpose of which will become clear from the discussion herein. Base plate 50 is preferably and conventionally spiked to base 52 which is advantageously an extension of the railroad ties supporting switch 12.

Furthermore, base plate 50 includes a centrally defined shaft-receiving hole 56 therein, the purpose of which will also become clear from the discussion herein.

Throw wheel 32 is preferably composed of cast aluminum and includes integral, circumferential, knurled, grasping bead 58 having a circular cross-sectional configuration, integral central portion 60 having a centrally disposed, wheel shaft aperture 62 defined therein, and elongated, locking-bar-receiving slot 64 defined along a radius thereof.

Wheel mounting means 66 rotatably mounts wheel 32 to frame 30 and includes wheel shaft 68 having one end thereof coupled in wheel shaft aperture 62, bearing mount 70 depending from overhanging portion 54, and bushing-type bearing 72, preferably zinc, extending through bearing mount 70 and receiving wheel shaft 68 therethrough. Wheel mounting means 66 mounts throw wheel 32 with its axis of rotation generally horizontal and at about chest height, preferably 43 inches.

Switch coupling means 34 includes upright, rotatable throw shaft 74, attachment means 76, and securement means 78.

Shaft 74 is disposed vertically through frame 30 with its lower end received in shaft receiving hole 56 and its upper end extending through top bushing 80 which is coupled through top wall 48. The upper end of shaft 74 includes switch-position-indicating circular banner 82 which extends above the upper level of throw wheel 32 to indicate the position of switch 12. Conventionally, banner 82 is colored red and is presented for viewing by an observer on track 14 to indicate that switch 12 is in the thrown position.

Attachment means 76 includes angled pinion gear 84 coaxially mounted to wheel shaft 68 and circular, downwardly oriented, rack gear 86 coaxially mounted to throw shaft 74. Rack gear 86 presents downwardly extending gear teeth 88 disposed therearound. As best viewed in FIGS. 3 and 6, gear teeth 88 engage corresponding teeth on pinion gear 84 for coupling wheel 32 with shaft 74 whereby rotation of wheel 32 about its horizontally oriented axis translates into rotation of throw shaft 74 about its vertically oreinted axis. Additionally, pinion gear 84 and rack gear 86 are configured so that one complete revolution of wheel 32 causes throw shaft 74 to rotate through an arc of about 90 degrees, that is, one-fourth of a revolution.

Figure 2:
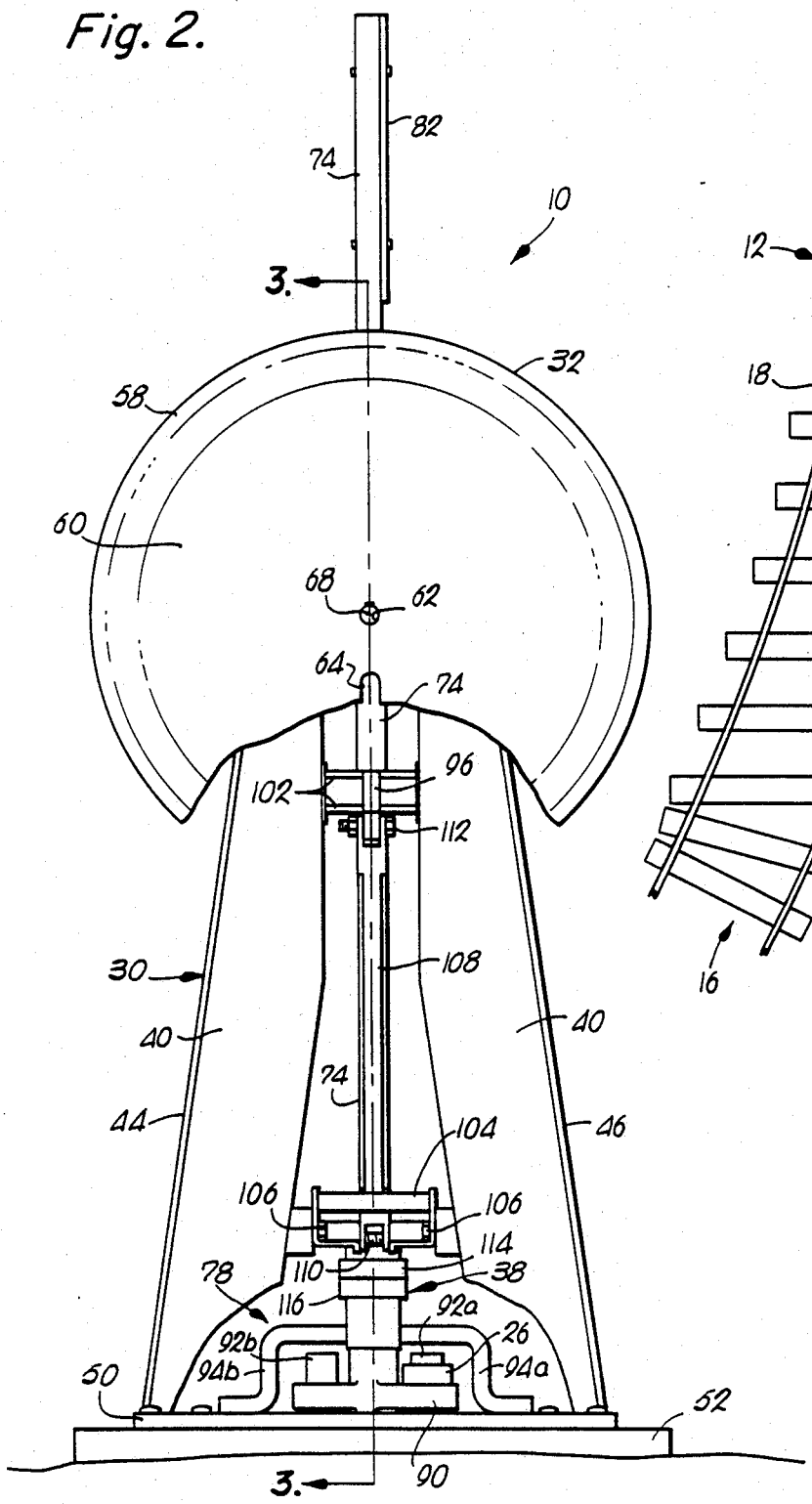
FIG. 2 is an elevational view of the switch stand in partial section.
Figures 3, 4:
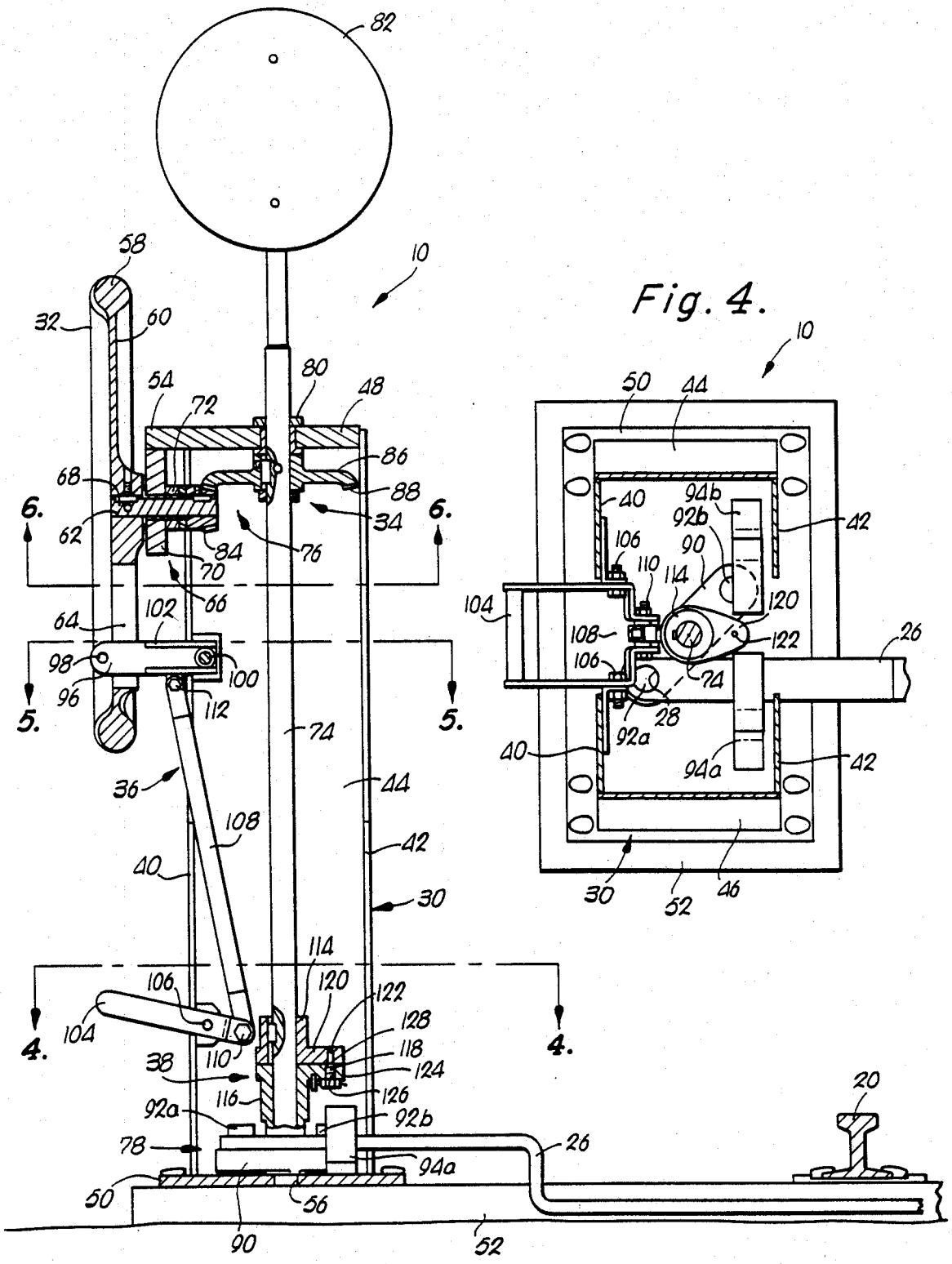
FIG. 3 is an elevational view of the switch stand in partial section along line 3—3 of FIG. 2.
FIG. 4 is a plan view of the switch stand in partial section along line 4—4 of FIG. 3.

Securement means 78 includes elongated link 90 pivotally mounted near the lower end of throw shaft 74. Link 90 includes cylindrical, upwardly extending bosses **92*a* and 92*b* disposed adjacent opposed ends of link 90 on opposed sides of shaft 74. As shown in FIGS. 2–4, boss 92*a* is pivotally received in pivot hole 28 of throw rod 26**.

Securement means 78 additionally includes steel, L-shaped retaining brackets **94*a* and 94*b* each having a respective leg welded to the base plate 50 and with the other respective legs thereof inwardly extending over the alternate paths of travel of throw rod 26 when alternately coupled to bosses 92*a,b*. Brackets 94*a,b* allow minimum clearance as respective bosses 92*a,b* travel underneath to prevent throw rod 26 from becoming uncoupled from the selected boss. Bosses 92*a*, 92*b* are alternately used depending on the desired action of the throw rod with respect to rotation of throw wheel 32. For example, as shown in the drawing figures, clockwise rotation of wheel 32 causes counterclockwise rotation of shaft 74 and link 90. With throw rod 26 coupled to boss 92*a*, throw rod 26 moves outwardly from switch stand 10, that is, to the left as viewed in FIG. 1, or to the right as viewed in FIG. 4**.

Locking means 36 includes elongated locking bar 96 having padlock hole 98 disposed adjacent the outboard end thereof. Bar 96 is pivotally mounted to frame 30 by means of locking bar pivot 100 which is mounted to the interior of front wall 40 with locking bar 96 extending outwardly therethrough. A pair of channel-shaped spacers 102 are welded to the upper and lower edges of bar 96 and thereby contribute to the structural strength of locking bar 96.

Locking means 36 also includes retraction pedal 104 pivotally mounted to frame 30 by retraction pivot 106 which is welded to the interior of front wall 40 with pedal 104 extending outwardly therethrough as shown in FIGS. 3 and 4.

Retraction link 108 extends through front wall 40 and pivotally interconnects pedal 104 with bar 96. Link pivot 110 pivotally couples one end of link 108 with the inboard end of pedal 104 and link pivot 112 pivotally couples the other end of link 108 with locking bar 96 as shown in FIGS. 3 and 4.

Disconnecting means 38 includes upper hub 114, lower hub 116, and threaded shear pin 118.

Upper hub 114 is fixedly mounted to throw shaft 74 and includes outwardly extending upper flange 120 having upper shear-pin-receiving hole 122 defined therein parallel to shaft 74. Lower hub 116 is welded or otherwise coupled to link 90 and further includes outwardly extending lower flange 124 having a lower, threaded, shear-pin-receiving hole defined therein parallel to shaft 74 and aligned with upper shear-pin-receiving hole 122.

Shear pin 118 is received through lower hole 126 and upper hole 122 thereby intercoupling shaft 74 with link 90. Shear pin 118 is configured according to conventional techniques to present a portion of weakness 128 which is positioned at the juncture between hubs 114 and 116. Portion of weakness 128 is designed to break upon experiencing a predetermined, given amount of shearing force corresponding to a predetermined given amount of torque existing between upper hub 114 and lower hub 116.

To use switch stand 10, initially the installer must decide on the desired action of throw rod 26 before base plate 50 is spiked in final position on base 52. For example, as shown on the drawing figures, switch stand 10 is shown using boss **92*a* which is chosen so that clockwise rotation of throw wheel 32 causes outward movement of throw rod 26 from switch stand 10. If switch stand 10, for example, were mounted on the other side of switch 12 (left side as viewed in FIG. 1) it would be desirable to use boss 92*b* so that clockwise rotation of throw wheel 32 would cause movement of throw rod 26 toward switch stand 10 in order to place switch 12 in the open position. During installation, switch stand 10 is arranged so that boss 92*a* is located between brackets 94*a, b,* and throw rod 26 is then placed with boss 92*a* received in pivot hole 28. Switch stand 10 is then adjusted to its final position and base plate 50 is then spiked in place on base 52**.

Normally, a switchman approaching switch stand 10 will find a padlock placed through padlock hole 98 in locking bar 96. The switchman removes the padlock and uses a foot to depress retraction pedal 104. Pedal 104 then rotates about retraction pivot 106 which moves retraction link 108 upwardly to thereby pivot locking bar 96 upwardly about locking bar pivot 100. Upward pivotal movement of locking bar 96 retracts it from slot 64 to thereby free throw wheel 32 for rotation.

The switchman then grasps throw wheel 32 about grasping bead 58 and begins to rotate wheel 32 clockwise to move switch 12 from the thrown position as illustrated in FIGS. 2–6 to the open position as shown in FIG. 1. As wheel 32 rotates and slot 64 moves beyond locking bar 96, the switchman can release retraction pedal 104 which allows the outboard end of locking bar 96 to ride against the inboard surface of central portion 60 of wheel 32.

As wheel 32 rotates about its horizontal axis, pinion gear 84 engages successive gear teeth 88 of rack gear 86 thus rotating throw gear 86 and throw shaft 74 in order to translate the clockwise rotation of wheel 32 into counter-clockwise rotation of throw shaft 74 about its vertical axis.

As throw shaft 74 rotates, banner 82 likewise rotates. Counter-clockwise rotation of throw shaft 74 causes counter-clockwise rotation of link 90 as viewed in FIG. 4. As link 90 rotates counter-clockwise, boss **92*a* moves to the right as viewed in FIG. 4 which also moves throw rod 26 outwardly thereby changing the position of switch 12 from the thrown position to the open position as illustrated in FIG. 1**.

The preferred arrangement of the mechanism of switch stand 10 is such that one complete revolution of wheel 32 causes throw shaft 74 and link 90 to rotate through 90 degrees. The pivotal coupling between throw rod 26 and link 90 by means of boss **92*a* is such that rotation of link 90 translates into axial movement of throw rod 26. Link 90 is sized so that its movement through an arc of 90 degrees causes sufficient axial movement of throw rod 26 to move switch 12** between respective open and thrown positions.

As throw wheel 32 completes its clockwise movement from its first, that is, thrown position, to its second or open position, slot 64 comes into alignment with locking bar 96 which then automatically falls by gravitation into slot 64 thereby locking wheel 32 and switch 12 in the open position. Additionally, in the open position, the face of banner 82 is parallel to track 14, that is edgewise to a viewer moving along track 14, which also indicates that switch 12 is in the open position.

A switchman may then replace a padlock in padlock hole 98 to prevent inadvertent or unauthorized operation of switch stand 10.

One skilled in the art will appreciate that the chest high location of wheel 32 allows the switchman to exert sufficient force to operate switch 12 and to do so safely without bending over or exposing legs or other body parts to potential injury. Additionally, the large diameter of wheel 32 and gearing arrangement between pinion gear 84 and rack gear 86 multiply the force exerted by the switchman on wheel 32 and apply that multiplied force to throw rod 26 so that minimal physical exertion is required to operate switch 12. In this way, potential injury is completely eliminated because a switchman can operate switch stand 10 while standing and with minimal physical effort.

To operate switch stand 10 from the open to the thrown position, the steps as outlined above are reversed. That is to say, the padlock is removed from padlock hole 98, retraction pedal 104 is depressed, and wheel 32 is rotated counterclockwise until slot 64 is once again aligned with locking bar 96 at which point switch 12 is in the thrown position.

One skilled in the art will appreciate that if switch 12 is in the thrown position, and a train inadvertently runs through the switch that is lined against it (from bottom to top as viewed in FIG. 1), the flanges of the wheels on the train will forcibly spread track 24 from track 20. In the event of such an occurrence, considerable axial force is exerted on throw rod 26 which severely damages a typical prior art switch stand.

With the switch stand of the present invention, however, damage is prevented because of the provision of disconnecting means 38. As viewed in FIG. 4, with switch 12 in the thrown position and with locking bar 96 in place in slot 64, excessive axial force on throw rod 26 (to the right as viewed in FIG. 4) will cause this force to be transmitted to the portion of weakness 128 on shear pin 118. Portion of weakness 128 is designed to break under such excessive force in order to allow movement of the throw rod 26. In this way, damage to switch stand 10 is prevented.

Additionally, disconnecting means 38 prevents damage to switch stand 10 in the event excessive force is applied to throw wheel 32. This might occur, for example, if a switchman attempts to forcibly operate switch 12 when the space between rails 24 and 20 is blocked with snow or gravel.

In the event shear pin 118 is broken, it is replaced by aligning hubs 114, 116 so that shear pin receiving holes 122 and 126 are aligned. The threaded portion of shear pin 118 is then removed from hole 126 which also allows the tip of shear pin 118 remaining in upper hole 122 to fall out through lower hole 126. A new shear pin is then threadably inserted through shear-pin-receiving hole 126 and into hole 122 thereby reconnecting hubs 114 and 116.

One skilled in the art will appreciate that the present invention contemplates many variations in the preferred embodiment herein described. For example, a hand crank could be used in place of or in combination with wheel 32 in order to provide a rotatable member conveniently located at chest height. Additionally, a conventional gear box could replace pinion gear 84 and rack gear 86 as a means to translate rotation of wheel 32 into rotation of shaft 74. Furthermore, any number of conventional gearing arrangements well known to those skilled in the art could be used to translate rotation of wheel 32 into longitudinal movement of throw rod 26. Finally, a shear pin could be used to releasably couple throw gear 86 to shaft 74, for example, instead of the preferred arrangement of hubs 114 and 116.

Having thus described the preferred embodiment of the present invention, we claim:

1. A switch stand for use with a railroad switch in order to enable a person to operate the switch between open and thrown positions, the switch having an elongated, generally horizontally disposed throw rod by which alternate, longitudinal movement thereof operates the switch between respective corresponding open and thrown positions, said switch stand comprising:

a hand-operable, rotatable member rotatable about a generally horizontal axis and including a graspable portion spaced from said axis for grasping by the person and for rotating said member about said horizontal axis;

means rotatably mounting said member with said horizontal axis about normal chest height of the person for rotation thereof about said horizontal axis;

an elongated, upright, rotatable throw shaft rotatable about an upright axis, said throw shaft presenting a lower portion located generally at the level of the throw rod and a remote upper portion extending upwardly at least to about the height of said horizontal axis;

attachment means intercoupling said member with said upper portion for translating rotation of said member about said horizontal axis into corresponding rotation of said shaft about said upright axis; and securement means separate from said attachment means for intercoupling said lower portion of said shaft with the throw rod and for translating rotation of said shaft about said upright axis into corresponding longitudinal movement of the throw rod, said switch stand being thereby structured so that the person may grasp the rotatable member at normal chest height and without bending over rotate said member about said horizontal axis in order to move the throw rod between the open and thrown positions.

2. The switch stand as set forth in claim 1, said rotatable member including a wheel presenting a peripheral portion thereof for grasping by the person in order to rotate said rotatable member and thereby operate the switch between said open and thrown positions.

3. The switch stand as set forth in claim 2, said attachment means and securement means including structure for alternately operating the switch between the open and thrown positions upon one complete revolution of said member.

4. The switch stand as set forth in claim 2, further including locking means for releasably and automatically locking said member alternately in first and second positions corresponding to respective open and thrown positions of the switch, said locking means including a retractable locking bar, structure defining a locking-bar-receiving slot in said wheel, means mounting said bar for retractable and alternate reception in said slot when said member is in said first and second positions for preventing rotation thereof, and retracting means coupled with said locking bar for selectively retracting said locking bar from said slot.

5. The switch stand as set forth in claim 1, said attachment means including a pinion gear coaxially mounted with said member and a rack gear engaging said pinion gear coaxially mounted to said shaft.

6. The switch stand as set forth in claim 1, said securement means including a link coupled with and extending outwardly from said lower portion of said shaft and including means for pivotally coupling with the throw rod, the throw rod having a connecting hole defined therein, said link including a boss received within said connecting hole for pivotal mounting therebetween.

7. The switch stand as set forth in claim 6, further including disconnecting means for operably disconnecting said member from the throw rod in the event excessive axial force is applied thereto, said disconnecting means including a first hub mounted to said shaft, a second hub mounted to said link, and a breakable shear pin intercoupling said hubs so that excessive axial force applied to the throw rod breaks said shear pin.

* * * * *